US010501240B2

(12) United States Patent
Sessions

(10) Patent No.: US 10,501,240 B2
(45) Date of Patent: Dec. 10, 2019

(54) PULL-OUT EXPANDABLE CONTRACTIBLE POUR SPOUT FOR A LIQUID CONTAINER WITH A POUR OPENING

(71) Applicant: Randy J. Sessions, Riverton, UT (US)

(72) Inventor: Randy J. Sessions, Riverton, UT (US)

(73) Assignee: Sessions/Painter, LLC, Riverton, UT (US)

( * ) Notice: Subject to any disclaimer, the term of this patent is extended or adjusted under 35 U.S.C. 154(b) by 0 days.

(21) Appl. No.: 16/151,574

(22) Filed: Oct. 4, 2018

(65) Prior Publication Data

US 2019/0031403 A1 Jan. 31, 2019

Related U.S. Application Data

(63) Continuation-in-part of application No. 15/644,155, filed on Jul. 7, 2017, now Pat. No. 10,124,930.

(51) Int. Cl.
*B65D 47/06* (2006.01)
*B65D 25/44* (2006.01)

(52) U.S. Cl.
CPC ..... *B65D 47/063* (2013.01); *B65D 25/44* (2013.01)

(58) Field of Classification Search
CPC ..... B65D 47/063; B65D 25/44
USPC ..... 222/527–530
See application file for complete search history.

(56) References Cited

U.S. PATENT DOCUMENTS

| | | | | |
|---|---|---|---|---|
| 1,397,612 | A | 8/1919 | Peppers | |
| 1,804,627 | A | 5/1931 | Lukenbill | |
| 2,804,242 | A | 8/1957 | Borah | |
| 2,895,654 | A | 7/1959 | Rieke | |
| 3,093,273 | A | 6/1963 | Borah | |
| 4,073,413 | A | 2/1978 | Tabler et al. | |
| 4,111,331 | A | 9/1978 | Summers | |
| 4,256,154 | A | 3/1981 | Black | |
| 4,817,832 | A | 4/1989 | Nagy | |
| 5,004,126 | A | 4/1991 | Klesius | |
| 5,088,632 | A * | 2/1992 | Odet | B65D 47/063 222/529 |
| 5,819,972 | A * | 10/1998 | Puente Pubill | B65D 25/44 220/255 |
| 8,430,279 | B2 | 4/2013 | Rigel | |
| 2004/0188474 | A1 | 9/2004 | Johnston Wills | |
| 2007/0056996 | A1 * | 3/2007 | Zijing | B65D 17/4012 222/530 |
| 2012/0085792 | A1 * | 4/2012 | Carriere | B65D 25/44 222/527 |

* cited by examiner

*Primary Examiner* — Donnell A Long
(74) *Attorney, Agent, or Firm* — Marcus G. Theodore

(57) ABSTRACT

A liquid container for motor oils, transmission fluids, cooking oils, liquors, etc. with pour opening associated with a telescoping expandable contractible pour spout, comprising a pull cap with a top and a finger pull ring affixed to the top, and a threaded pull cap base. The telescoping expandable contractible pour spout is flexible defining a continuous interior channel in communication with the interior of the liquid container having two first and second co-acting segments operably associated with the pull cap and the pour opening of the fluid container, which extends in a pour position, and collapses back into the pour opening in a storage position.

4 Claims, 5 Drawing Sheets

PULL-OUT EXPANDABLE CONTRACTIBLE POUR SPOUT FOR A LIQUID CONTAINER WITH A POUR OPENING

RELATED APPLICATIONS

This patent application is a continuation-in-part of U.S. patent application Ser. No. 15/644,155 filed Jul. 7, 2017 entitled "Internal Pull Out Expandable Contractible Pour Spout Insert for Containers", which is a continuation-in-part of U.S. patent application Ser. No. 14/701,846 filed May 1, 2017 entitled "Internal Pull-Out Expandable Contractible Pour Spout Cap for Liquid Container Openings, which is dependent upon U.S. Provisional Patent Application, Ser. No. 62/002,845 filed May 24, 2014 entitled "Internal Pull-Out Expandable Contractible Pour Spout Insert for Containers".

BACKGROUND OF THE INVENTION

Field

This invention pertains to container pour spouts. More particularly it relates to a liquid container with an expandable contractible pour spout for motor oils, transmission fluids, cooking oils, liquids, liquors, etc.

Statement of the Art

A variety of pour spouts and funnels for pouring liquids from containers are known. Tabler et al., U.S. Pat. No. 4,073,413 issued Feb. 14, 1978 discloses a retractable and extendable container pour spout. Summers, U.S. Pat. No. 4,111,331 issued Sep. 5, 1978 discloses a tamper proof container with an extendable pour spout. Klesius, U.S. Pat. No. 5,004,126 issued Apr. 2, 1991 discloses a container with a flexible bellows with pour spout. Rieke, U.S. Pat. No. 2,895,654 issued Jul. 21, 1959 discloses a nested extendable flexible pour spout for containers. Peppers, U.S. Pat. No. 1,397,612 issued Aug. 13, 1919 discloses an oil can with a pour spout which can cut off flows. Lukenbill, U.S. Pat. No. 1,804,627 issued May 12, 1931 discloses a sanitary pouring cap with accordion extending and retracting pour spout. Borah, U.S. Pat. No. 3,093,273 issued Jun. 11, 1963 discloses a retractable and extendable container spout. Nagy, U.S. Pat. No. 4,817,832 issued Apr. 4, 1989 discloses a telescoping nozzle assembly adapted to be secure to the opening of container to facilitate pouring of container fluid. Johnston Wills, Pub. No. US 2004/0188474 published Sep. 30, 2004 discloses a collapsible/flexible pouring attachment to pour liquid from a plastic bottle and/or container. Borah, U.S. Pat. No. 2,804,242 issued Aug. 27, 1957 discloses a container spout and gasket combination. Rigel, U.S. Pat. No. 8,430,279 issued Apr. 30, 2013 discloses a bottle accessory for application with a cap to the neck of a bottle, particularly useful for attaching a retractable spout to a bottle.

Cited for general interest is Black, U.S. Pat. No. 4,256,154 issued Mar. 17, 1981 disclosing a bottle with retractable funnel top.

Other devices are secured to the opening of a liquid container to assist in pouring therefore. Motor oil and transmission fluid pour spouts typically have a fixed or flexible hose with mounting adapted to screw onto the exterior threads of an opened container. Cooking oils have a spout with mountings adapted to insert into the opening of a container opening. Funnels come in a variety of shapes and designs to contain and direct fluids into a desired bottle or container.

Most of these pour spouts and funnels are combination cap/pour spouts that are difficult to construct, produce, or to secure to the opening of a liquid container. Other separate pour spout and funnel devices are required to be applied after a fluid container is opened.

There thus remains a need for an expandable contractible pour spout for a liquid container with a pour opening for motor oils, transmission fluids, cooking oils, liquids, liquors, etc. to eliminate the need for finding a funnel or other pour spouts to aid in pouring. The apparatus described below provides such an invention.

SUMMARY OF THE INVENTION

The present invention comprises an expandable contractible pour spout for a liquid container with a pour opening. It comprises a pull cap with a top and a finger pull ring affixed to the top, and a threaded pull cap base. A flexible extendable contractible telescoping accordion pour spout having two first and second co-acting segments is threaded and removably screwed onto the pull cap at one end and sealed to the opening of the fluid container at the other end.

The first pour spout segment has an interior channel in communication with an open first threaded end adapted to secure to the threaded pull cap base for removal for pouring or replacement for storage. The first accordion pour spout segment second end has walls defining a base with an opening in communication with its interior channel.

The second accordion segment has a second interior channel structured to surround the first accordion pour spout segment. It has top and bottom openings in communication with its second interior channel. The top opening is sealed and secured to the opening of the fluid container such that the second channel is in communication with the interior of the fluid container. The second accordion segment bottom opening is sealed to the base of the second end of the first accordion pour spout segment such that the second interior channel is in communication with the interior channel of the first accordion pour spout segment forming a continuous channel in communication with the interior of the fluid container. These two accordion segments co-act such that the first accordion pour spout segment may contract extending into the interior of the fluid container pour opening when the first accordion pour spout is collapsed for storage within the second accordion segment extending into the interior of the liquid container. Alternatively, the second accordion segment may contract against the opening of the fluid container when the first accordion segment of the pour spout is extended for pouring.

The pull cap base is removably secured to the threaded first end of the accordion pour spout to close its channel in a storage mode. The pull cap base is then removed after the pull cap extends the first pour spout segment and unblocks the pour spout channel for pouring in a pouring mode.

The liquid container with an expandable contractible pour spout may include a storage cap with threaded exterior sidewalls sized and structured to encase the collapsed accordion pour spout within the opening of the fluid container by securing to corresponding external threads of the pour spout opening.

The invention thus provides a simple cost effective expandable contractible pour spout for a liquid container with a pour opening that can be manufactured in different sizes to adapt to most containers to provide a container with a built in pour spout. This eliminates the need for funnels and additional attachable spouts, which are more expensive. It provides a container with a flexible plastic spout that sits inside the opening of a fluid container with a removable pull top cap.

DESCRIPTION OF THE ILLUSTRATED EMBODIMENTS

Figure 1:
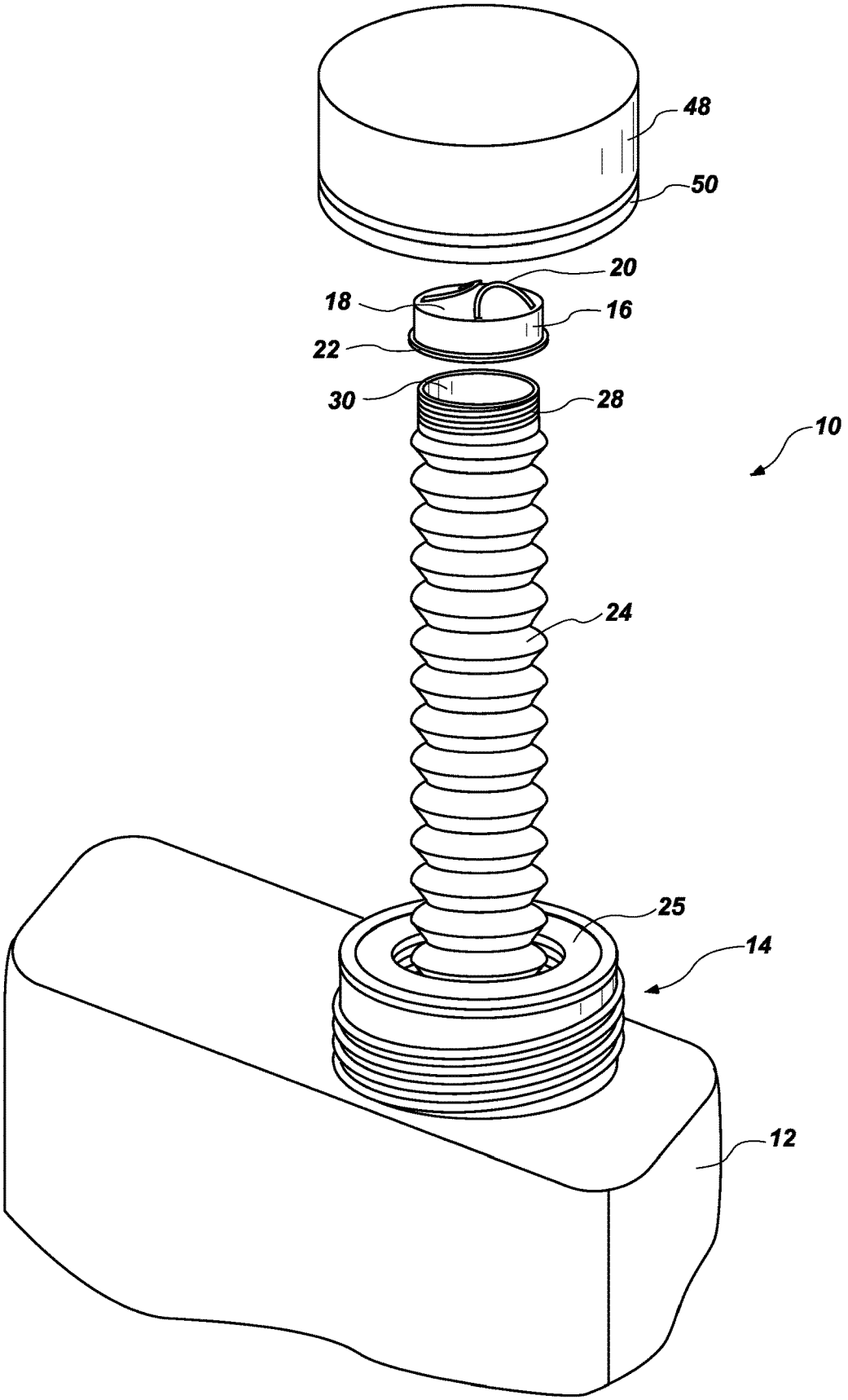
FIG. 1 illustrates a perspective view of the extended pour spout affixed to the pour opening of a fluid container.

FIG. 1 illustrates a perspective view of an expandable contractible pour spout 10 for a liquid container 12 with an interior in communication with a pour opening 14 the liquid container 12. The pour spout 10 is a flexible extendable contractible telescoping accordion pour spout 10 associated with the liquid container threaded pour opening 14, It comprises a pull cap 16 with a top 18 having a finger pull ring 20 affixed to the top 18, and a threaded pull cap base 22. The flexible extendable contractible telescoping accordion pour spout 10 has two segments 24, 25 operably associated with the pull cap 16 and the threaded opening 14 of the fluid container 12.

Figure 4:
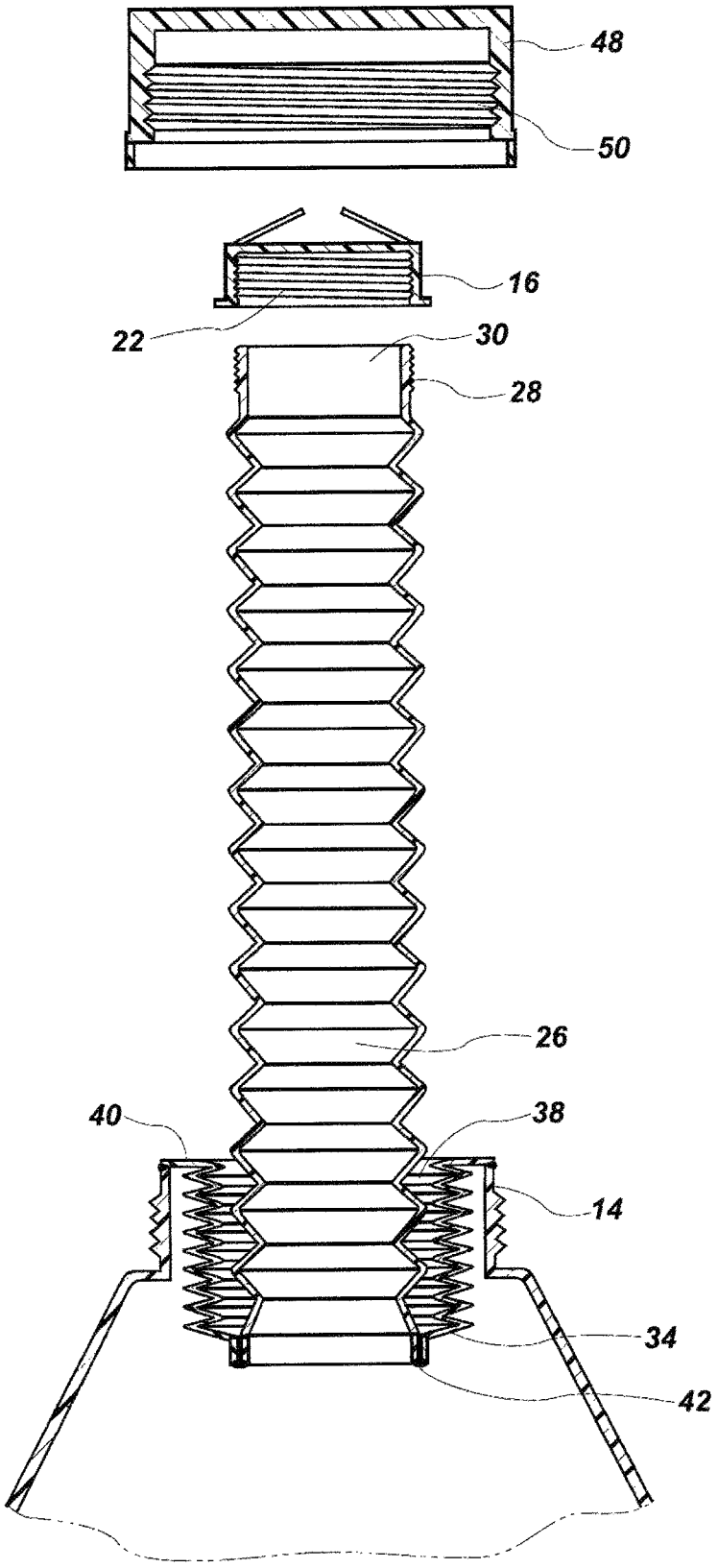
FIG. 4 illustrates a cross section of the pour spout affixed to a fluid container opening with the accordion first segment extended and the second segment contracted.

The first pour spout segment 24 has an interior channel 26 shown in FIG. 4 with a threaded end 28 defining an opening 30 in communication with the interior channel 26 adapted to removably secure to the threaded pull cap base 22 for closure for storage, or removal for pouring. The first accordion pour spout segment 24 also has a second end 32 with walls defining a base 34 with an opening 36 in communication with its interior channel 26.

A second accordion segment 25 with a second channel 38 shown in FIG. 4 is structured to surround and accommodate the first accordion pour spout segment 24. It has top and bottom openings 40, 42 in communication with the second channel 38. The top opening 40 is sealed and secured to the opening 14 of the fluid container 12 such that the second channel 38 is in communication with the interior of the fluid container 12. The bottom opening 42 is sealed to the base 34 of the second end 32 of the first accordion pour spout segment 24 such that the second channel 38 is in communication with the interior channel 26 of the first accordion pour spout segment 24. These two accordion segments 24, 25 co-act such that the first accordion pour spout segment 24 extends into the interior of the fluid container 12 pour opening 14 when the first accordion pour spout segment 24 is collapsed for storage therein. The second accordion segment 25 then contracts against the pour opening 14 of the fluid container when the first accordion pour spout segment 24 is extended for pouring.

The pull cap base 16 is removably secured to the threaded first end 28 of the accordion pour spout segment 24 to close its channel 26 in a storage mode. The pull cap base 16 is then removed after the pull cap 16' is pulled and removed to extend the pour spout segment 24 channel 26 for pouring in a pouring mode.

The flexible extendable contractible telescoping accordion pour spout 10 may include a storage cap 48 with sidewalls 50 sized and structured to encase the collapsed accordion pour spout 10 within the opening 14 of the fluid container 12 by removably securing to corresponding external threads 52 of the pour spout opening 14.

Figure 2:
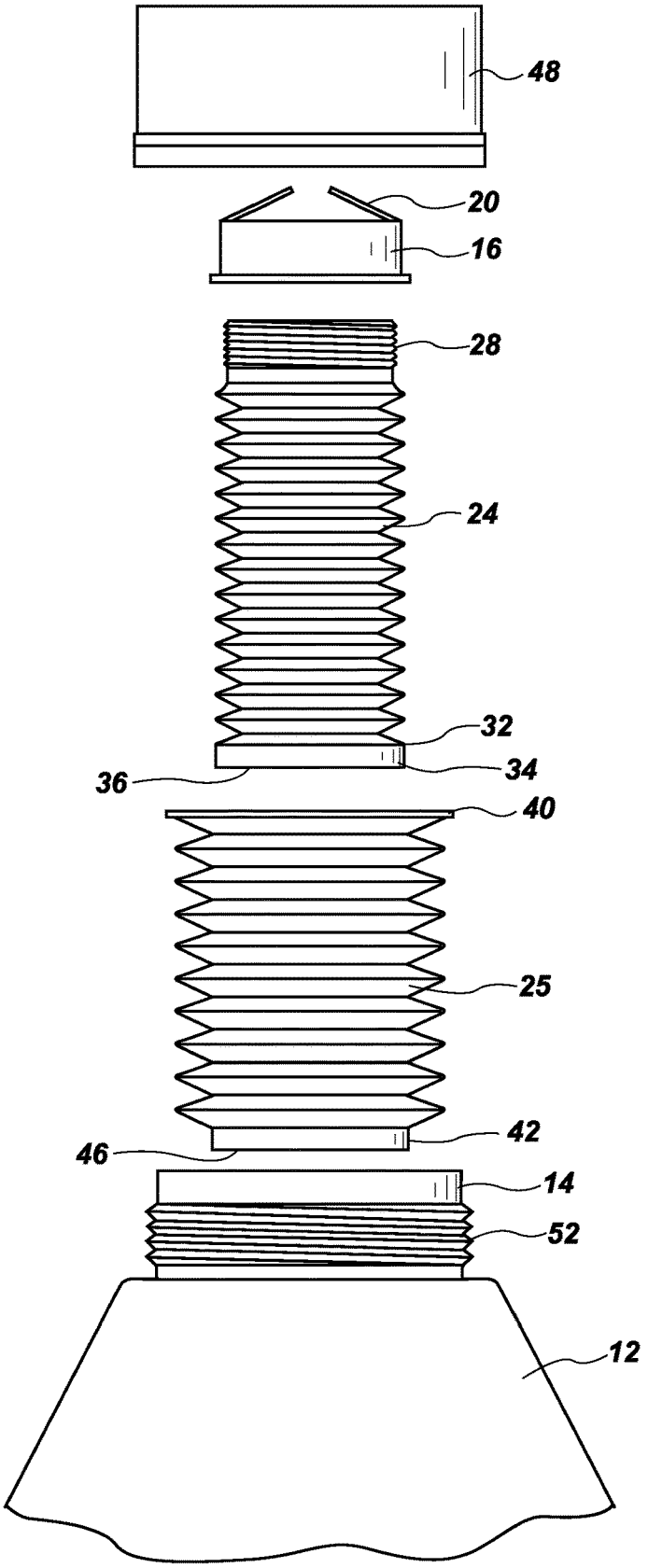
FIG. 2 illustrates an expanded side view of the unconnected pour spout components of FIG. 1.

FIG. 2 illustrates an expanded side view of the unconnected pour spout 10 components of FIG. 1.

Figure 3:
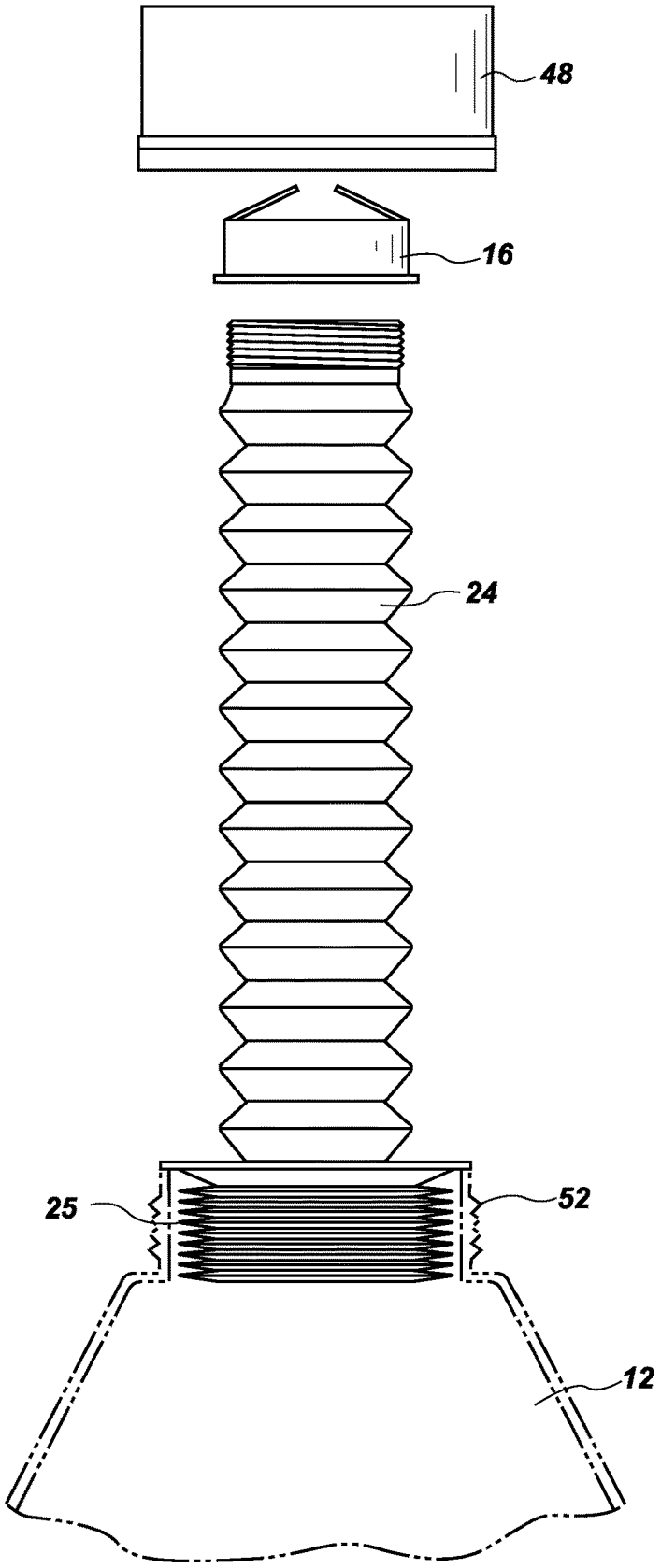
FIG. 3 illustrates the pour spout components of FIG. 2 connected.

FIG. 3 illustrates the pour spout 10 components of FIG. 2 connected.

FIG. 4 illustrates a cross section of the pour spout 10 of the FIG. 3 fluid container opening 14 with the storage cap 48 and pull cap 16 removed for pouring. The first accordion segment 24 is extended contracting the second accordion segment 25 against the fluid container opening 14 forming a continuous channel in communication with the interior of the fluid container 12 for pouring.

Figure 5:
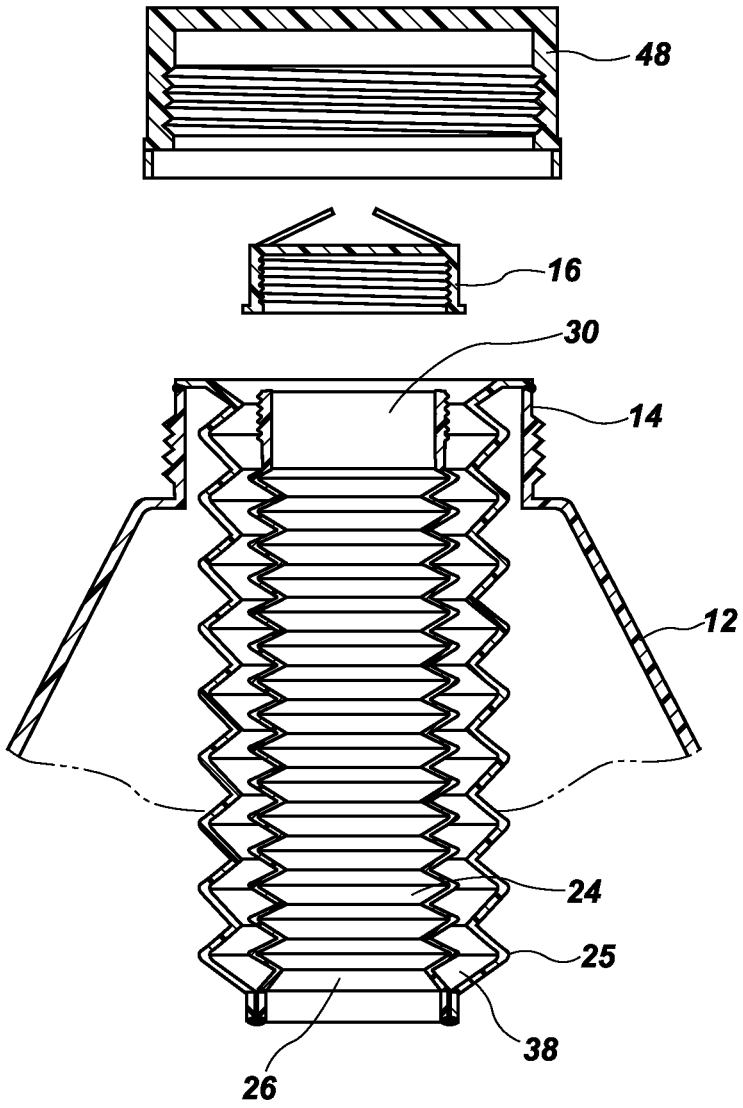
FIG. 5 illustrates a cross-sectional view of the pour spout contracted to fit within the fluid container opening with the first segment contracted and the second segment extended.

FIG. 5 illustrates a cross-sectional view of the pour spout 10 contracted to fit within the fluid container 12 pour opening 14 with the first accordion segment 24 contracted and the second accordion segment 25 extended into the interior of the fluid container for storage.

The present invention may be embodied in other specific forms without departing from its structures, methods, or other essential characteristics as broadly described herein and claimed hereinafter. The described embodiments are to be considered in all respects only as illustrative, and not restrictive.

The scope of the invention is, therefore, indicated by the appended claims, rather than by the foregoing description. All changes that come within the meaning and range of equivalency of the claims are to be embraced within their scope.

I claim:

1. An expandable contractible pour spout for a liquid container with an interior in communication with a pour opening, comprising:

a. a removable pull cap with a top affixed with a finger pull ring, and a threaded pull cap base, b. a flexible extendable contractible telescoping accordion pour spout having two segments:

i. a first accordion pour spout segment defining a first interior channel with a first threaded open end adapted to removably secure to the threaded pull cap base for removal for pouring or replacement for storage, and a second open end in communication with the first interior channel, ii. a second accordion segment with an open top and bottom defining a second interior channel sized to accommodate and surround the first accordion pour spout segment; the open top sealed and secured to the pour opening of the fluid container such that the second channel is in communication with the interior of the fluid container, and a bottom with an opening in communication with the second interior channel sealed to the second end of the first accordion pour spout segment such that the second interior channel is in communication with the first interior channel of the first accordion pour spout segment;

said first and second accordion segments structured to co-act, with the first accordion segment:

i. contracting within the second accordion segment when the second accordion segment extends into the interior of the fluid container for storage of both first and second accordion pour spout segments therein for storage, and ii. extending beyond the second interior of the second accordion segment for pouring causing the second accordion segment to contract against the pour opening of the fluid container for pouring.

2. An expandable contractible pour spout for a liquid container with an interior in communication with a pour opening according to claim 1, wherein the pull cap threaded pull cap base has internal threads to secure to corresponding external threads of the first accordion segment threaded open end.

3. An expandable contractible pour spout for a liquid container with an interior in communication with a pour opening according to claim 1, including a storage cap with sidewalls sized and structured to encase the collapsed flexible extendable contractible telescoping accordion pour spout within the pour opening.

4. An expandable contractible pour spout for a liquid container with an interior in communication with a pour opening to claim 1, wherein the storage cap with sidewalls interior is threaded to removably secure to corresponding exterior threads of the pour spout.

* * * * *